US005297738A

United States Patent [19]

Lehr et al.

[11] Patent Number: 5,297,738

[45] Date of Patent: Mar. 29, 1994

[54] APPARATUS FOR ELECTROSTATIC ATOMIZATION OF LIQUIDS

[75] Inventors: Walter Lehr, Stuttgart; Guenter Schirmer, Ingersheim, both of Fed. Rep. of Germany

[73] Assignee: Robert Bosch GmbH, Stuttgart, Fed. Rep. of Germany

[21] Appl. No.: 839,151

[22] Filed: Feb. 21, 1992

[30] Foreign Application Priority Data

Mar. 1, 1991 [DE] Fed. Rep. of Germany ..... 4106563

[51] Int. Cl.[5] ..... B05B 5/025

[52] U.S. Cl. ..... 239/708; 204/302; 239/493

[58] Field of Search ..... 204/275, 302; 239/493, 239/690, 708

[56] References Cited

U.S. PATENT DOCUMENTS

| | | | |
|---|---|---|---|
| 4,435,261 | 3/1984 | Mintz et al. | 204/168 |
| 4,508,265 | 4/1985 | Jido | 239/708 |
| 4,605,485 | 8/1986 | Cerkanowicz | 204/302 |
| 4,667,226 | 4/1987 | Mintz et al. | 204/186 |

FOREIGN PATENT DOCUMENTS

| | | | |
|---|---|---|---|
| 2850776 | 7/1979 | Fed. Rep. of Germany | B05B 5/02 |

*Primary Examiner*—John Niebling
*Assistant Examiner*—William T. Leader
*Attorney, Agent, or Firm*—Edwin E. Greigg; Ronald E. Greigg

[57] ABSTRACT

An apparatus for electrostatic atomization of liquids, particularly fuel, has a nozzle, which has a nozzle body of electrically conductive material, connected to ground potential, with a nozzle opening for the emergence of a volume of liquid under pressure and has an electrode in the nozzle body, coaxially opposite the nozzle opening, which electrode is at a high-voltage potential. To avoid a corona discharge of the electrically charged liquid volume emerging from the nozzle opening, which would limit the magnitude of the possible electric charging of the liquid volume in the nozzle and thus the degree of atomization, nonelectrical means are provided toward the nozzle opening for atomizing the liquid volume as it emerges from the nozzle, and these means are embodied such that the mechanical breakaway forces they produce in the liquid volume are effective sooner than the forces of electrostatic repulsion prevailing between the liquid droplets. One example of such means is swirl conduits that discharge immediately upstream of the nozzle opening.

2 Claims, 1 Drawing Sheet

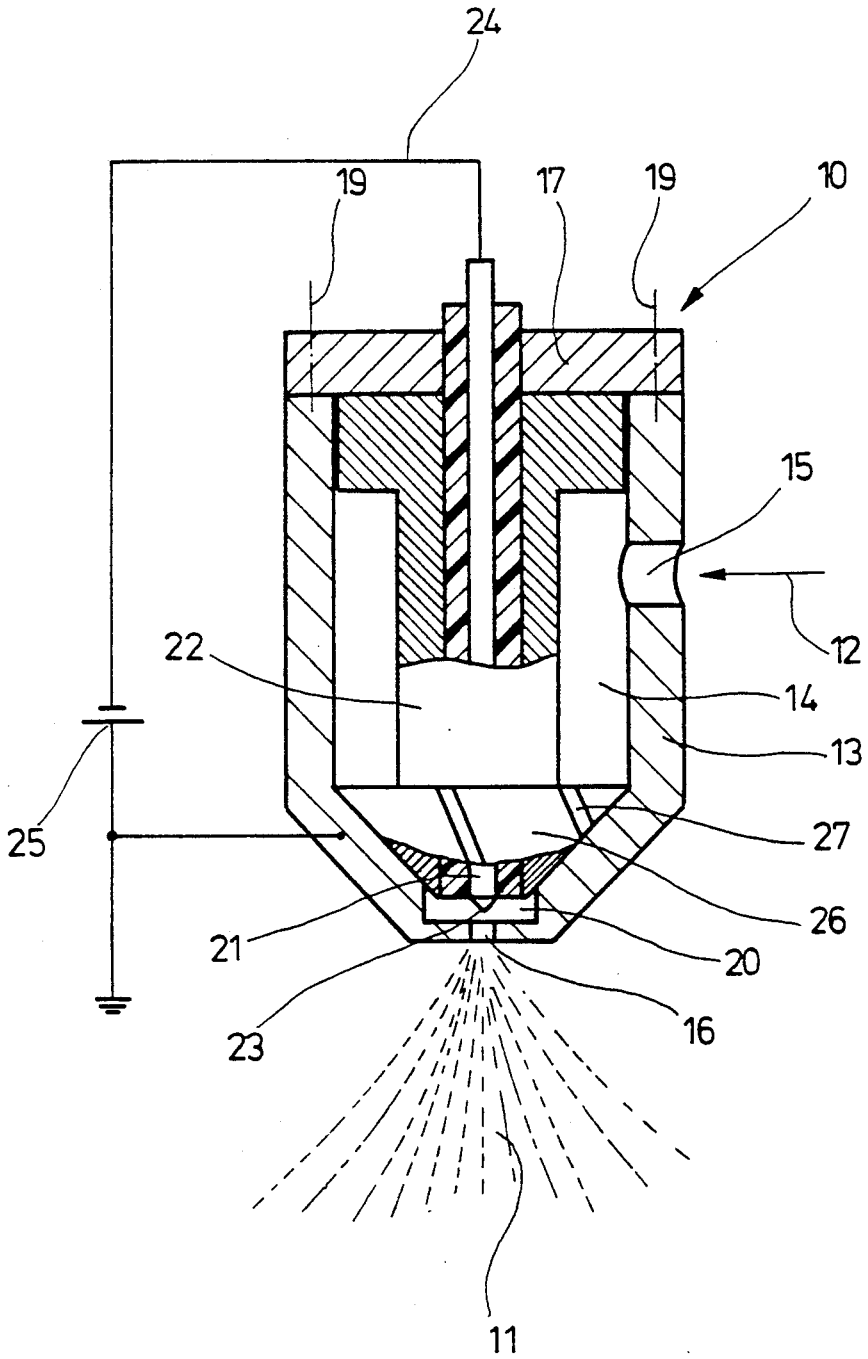
24
19
17
19
10
15
12
22
14
13
25
27
26
21
20
23
16
11

APPARATUS FOR ELECTROSTATIC ATOMIZATION OF LIQUIDS

RELATED APPLICATION

This application relates to matter in a similar application filed simultaneously by the same applicants, (R.24206) German Patent Appl. No. P 41 06 564.6, identified by Ser. No. 07/839,158, filed in the U.S. Patent & Trademark Office on Feb. 21 1992.

BACKGROUND OF THE INVENTION

The invention is based on an apparatus for electrostatic atomization of liquids, particularly fuel as defined hereinafter.

In an atomizer of this kind, the liquid is passed through the electrical field developed between the electrode and the nozzle body, causing it to charge electrically. This charging causes the liquid to be atomized after it leaves the nozzle. To obtain good atomization with the smallest possible mean droplet diameters, the liquid must be electrically charged as high as possible.

In a known apparatus of this kind (German Patent Document 28 50 116 A1), the high voltage between the nozzle body, which is at ground, and the electrode, which is at negative potential, amounts to up to 30 kV. However, it has been found that if it is used for nonconductive liquids, one example of which is fuel, the attainable charge density and thus the fineness of the atomization is limited by a corona discharge of the stream of liquid emerging from the nozzle opening. The process of corona discharge takes place as a result of the draining of the charge, located at the surface of the stream, along the interface between the liquid and the ambient gas toward the outside of the nozzle.

OBJECT AND SUMMARY OF THE INVENTION

The apparatus according to the invention for electrostatic atomization of liquids, particularly fuel, has an advantage over the prior art that because of the rapid atomization, by nonelectrical forces, of the liquid emerging from the nozzle opening, the ejected fuel stream quickly separates or breaks away from the nozzle body, thereby breaking the electrical connection of the charged fuel stream with the usually grounded nozzle. This break prevents the drainage of a charge along the interface between the liquid and the ambient gas toward the outside of the nozzle and thus limits the corona discharge. The means for nonelectrical atomization of the liquid stream need not be designed additionally from the standpoint of good mechanical atomization, because the quality of atomization is determined by the subsequent electrostatic atomization. Accordingly, the efficiency of the apparatus of the invention is independent of the nature of the gas atmosphere.

In a preferred embodiment of the invention, the means for atomizing the liquid stream are embodied at the outlet from the nozzle opening by so-called swirl conduits, which lead to the nozzle opening and lend the liquid emerging therefrom a centrifugal acceleration as it leaves the nozzle. The swirl conduits are preferably embodied in a truncated cone, which is inserted into the nozzle body and separates an antechamber disposed immediately in front of the nozzle opening from a nozzle chamber that can be filled with liquid.

In addition to a swirl nozzle of this kind, other mechanical operative principles that cause a rapid separation of liquid from the nozzle can also be used. These operative principles may be based on pressure, friction with the ambient atmosphere at the nozzle, air envelopment, mixing of the liquid with a gas phase, or breakaway forces at the nozzle outlet edges.

The invention will be better understood and further objects and advantages thereof will become more apparent from the ensuing detailed description of a preferred embodiment taken in conjunction with the drawing.

BRIEF DESCRIPTION OF THE DRAWING

The single figure of the drawing is a longitudinal section through an electrostatic atomizer apparatus for fuel, shown schematically.

DESCRIPTION OF THE PREFERRED EMBODIMENT

The apparatus schematically shown in the drawing for electrostatic atomization of fuel, as an example of the atomization of electrically nonconductive liquids, has an injection nozzle 10, by means of which a metered volume of fuel is injected and in the process highly finely atomized electrostatically to form a so-called spray mist 11. The fuel, which is at high pressure is delivered to the injection nozzle by a fuel injection pump or a fuel injection valve via a fuel line symbolized by the arrow 12.

The injection nozzle 10, shown schematically in longitudinal section, has a nozzle body 13 of electrically conductive material, which encloses a fuel-filled nozzle chamber 14 that communicates with the fuel line 12 via at least one radial bore 15 in the nozzle body 13. On its lower end, the nozzle body 13 is embodied frustoconically, and in its free end face it has a coaxial nozzle opening 16. On the opposite face end the nozzle body 13 is covered by a plate 17, which is fastened to the nozzle body 13 with screw 19. Immediately in front of the nozzle opening 16 is an antechamber, into which an emitter electrode 21 projects. The electrode 21 is received in insulated fashion in a holder 22 and protrudes from it with a conical tip 23. On the end remote from the conical tip 23, the electrode 21 is connected to an electrical connection line 24, which is connected to the negative high voltage potential of a high voltage source 25, while the nozzle body 13 is connected to the ground potential. The electrode 21 comprises some material that is suitable for the field emission of electric charge carriers. One example of such a material is a eutectic mixture of uranium oxide and tungsten. This material has sufficiently many fine points and edges, so that sufficiently high electric fields can be generated at the surface of the material for field emission purposes. The fuel passed through the electrostatic field in the antechamber 20 absorbs charges, so that it leaves the antechamber 20 through the nozzle opening 16 in an electrically negatively charged state. Because of the charging thus attained, the fuel after it leaves the nozzle opening atomizes into a very fine spray mist 11, because of the electrical forces of repulsion operative between the charges.

To prevent a corona discharge of the stream of liquid emerging from the nozzle opening 16, a frustoconical flange 26 is disposed on the holder 22; in the lower, frustoconical region of the nozzle body 13, this flange rests sealingly on the inner wall of the nozzle body and partitions off the antechamber 20 from the nozzle chamber 14. A plurality of swirl conduits 27 are machined into the jacket face of the frustoconical flange 27, extending at an acute angle relative to the axis of the holder or truncated cone, and discharging at one end in the nozzle chamber 1 and at the other in the antechamber 20. Via these swirl conduits 27, the fuel injected at pressure into the nozzle chamber 27 flows to the antechamber 20, where it emerges at high speed from the nozzle opening 16. Because of the swirl conduits 27, the emerging fuel is given a swirled acceleration, such that mechanical breakaway forces are produced in the emerging fuel volume; these are effective sooner than the electrostatic forces of repulsion that prevail between the electrically charged droplets of liquid. As a result, the fuel stream breaks off very quickly from the outside of the injection nozzle 10, and a corona discharge of the electrically charged fuel stream across the outside of the nozzle is prevented. The electrostatic atomization that then ensues, because of the forces of repulsion between the fuel droplets, leads to a very high degree of atomization of the fuel in the spray mist 11.

The invention is not limited to the exemplary embodiment described above. Instead of the truncated cone 26 with swirl conduits 27, or in other words instead of a so-called swirl nozzle, other nonelectrical means may also be used that effect an atomization of the liquid volume upon emerging from the nozzle such that the breakaway forces generated by them in the liquid volume are effective sooner than the forces of electrostatic repulsion prevailing between the liquid droplets. Such means may be achieved by using other mechanical principles, such as pressure, friction with the ambient atmosphere of the injection nozzle 10, air envelopment, mixing of the liquid with a gas phase, or by means of breakaway forces at the nozzle outlet edges.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. An apparatus for electrostatic atomization of liquids having an injection nozzle (10), sad injection nozzle has an electrically conductive nozzle body (13), said nozzle body includes a nozzle opening (16) from which a volume of fluid under pressure emerges, an electrode (21) int he nozzle body, said electrode is secured near and coaxially opposite the nozzle opening, a power supply means connected to said electrode and said nozzle and adapted to supply a high-voltage potential relative to the electrode (21) and the nozzle body, nonelectrical means are disposed within an interior of said injection nozzle relative to the nozzle opening (16) for atomizing the liquid volume upon its emergence from the nozzle, said nonelectrical means are embodied by swirl conduits (27) which extend in an inclined fashion relative to a longitudinal axis of the nozzle body (13) and carry a liquid from a liquid-filled nozzle chamber (14) to the nozzle opening (16), the swirl conduits (27) are embodied in a truncated cone (26) inserted into the nozzle body (13), in which the truncated cone in the nozzle body (13) separates an antechamber (20) located immediately in front of the nozzle opening (16) from the nozzle chamber (14) that can be filled with liquid, said nonelectrical means are embodied such that mechanical breakaway forces generated by said nonelectrical means int he liquid volume are effective sooner than the forces of electrostatic repulsion prevailing between liquid droplets are formed.

2. An apparatus as defined by claim 1, in which the swirl conduits (27) extend in a jacket face of the truncated cone (26) at an acute angle to the axis of the truncated cone from one end at the nozzle chamber (14) and discharge at another end in the antechamber (20).

* * * * *